United States Patent [19]

Tandeski et al.

[11] Patent Number: 4,739,630

[45] Date of Patent: Apr. 26, 1988

[54] HEAT EXCHANGER ASSEMBLY AND METHOD OF FABRICATING SAME

[75] Inventors: David A. Tandeski; Roger W. Paul, both of Albert Lea, Minn.

[73] Assignee: King-Seeley Thermos Co., Prospect Heights, Ill.

[21] Appl. No.: 63,103

[22] Filed: Jun. 17, 1987

[51] Int. Cl.[4] ..... F25C 1/14

[52] U.S. Cl. ..... 62/354; 62/518; 165/169; 29/157.3 C; 29/446; 228/183

[58] Field of Search ..... 165/168, 169; 62/354, 62/518; 29/157.3 C, 157.3 R, 446; 228/183

[56] References Cited

U.S. PATENT DOCUMENTS

| | | | |
|---|---|---|---|
| 1,841,762 | 1/1932 | Samesreuther et al. | 165/169 |
| 1,886,553 | 11/1932 | Kercher | 165/169 |
| 1,987,707 | 1/1935 | Replogle | 165/169 |
| 2,266,766 | 12/1941 | Knight | 62/342 |
| 2,373,038 | 4/1945 | Lindsay | 29/452 |
| 2,578,917 | 12/1951 | Bisch | 185/186 |
| 2,579,898 | 12/1951 | Brucker | 165/169 X |
| 2,616,270 | 11/1952 | Field | 62/106 |
| 3,120,869 | 2/1964 | Carpenter | 165/172 |
| 3,143,167 | 8/1964 | Vieth | 165/169 |
| 3,196,624 | 7/1965 | Reynolds | 62/354 |
| 3,464,220 | 2/1968 | Phelan | 62/342 |
| 3,498,371 | 3/1970 | Zygiel | 165/169 X |
| 3,972,821 | 8/1976 | Weidenbenner et al. | 165/164 |
| 4,144,875 | 3/1979 | Bruno et al. | 165/168 X |
| 4,185,369 | 1/1980 | Darrow et al. | 165/185 |

FOREIGN PATENT DOCUMENTS

| | | | |
|---|---|---|---|
| 377398 | 7/1932 | United Kingdom | 165/169 |

*Primary Examiner*—William E. Tapolcai
*Attorney, Agent, or Firm*—Harness, Dickey & Pierce

[57] ABSTRACT

An improved heat exchanger assembly is disclosed and has a wall composed of a heat transmissive material and a plurality of sections of spaced-apart elongated fluid conduits also composed of a heat transmissive material disposed on one side of the wall for conveying a heat transfer fluid therethrough. The assembly includes an elongated filler member, which either has a solid outer surface or is a wire mesh structure, and which extends longitudinally through the space between at least one adjacent pair of the spaced-apart elongated fluid conduits or conduit sections. The elongated filler member is also composed of a heat transmissive material and at least in part spaced from the fluid conduit or conduit sections, thus defining at least one opening providing communication into the space between the adjacent pair of fluid conduits. A heat transmissive fusion material, such as silver solder for example, substantially fills the opening or openings and contacts the filler member, the wall, and fluid conduits in order to bond them to one another and to provide a heat transmissive path therebetween. Preferably, the heat transmissive fusion material is introduced into the opening or openings in a flowable state, with the flowable fusion material flowing into the openings under the influence of capillary action. Such openings can optionally be defined and formed by way of a plurality of discontinuities spaced apart along the filler member and contacting the adjacent fluid conduit or conduit sections.

39 Claims, 2 Drawing Sheets

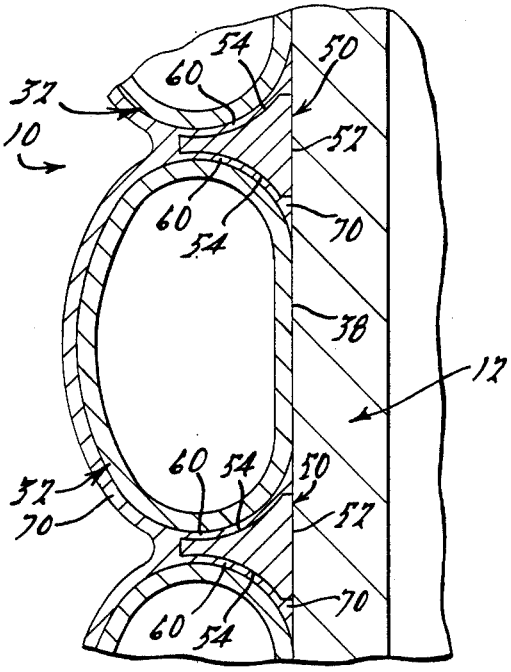
FIG. 2.
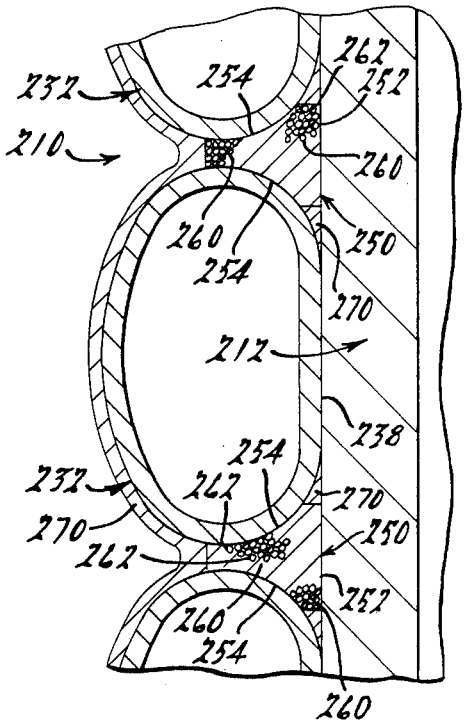
FIG. 4.
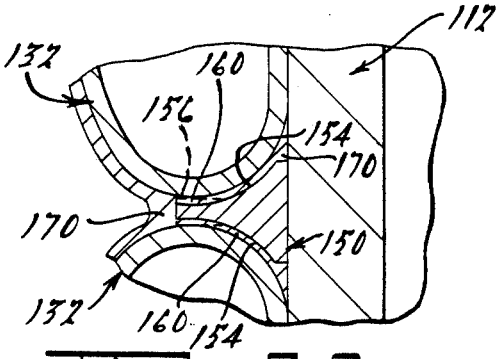
FIG. 2A.
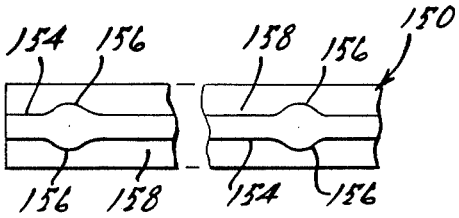
FIG. 3.
FIG. 5.
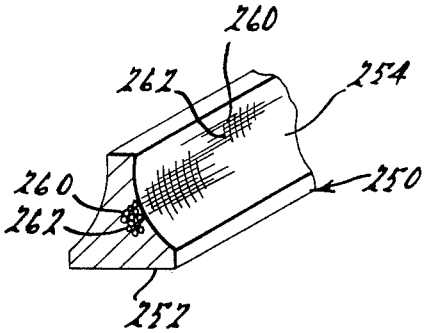

HEAT EXCHANGER ASSEMBLY AND METHOD OF FABRICATING SAME

BACKGROUND AND SUMMARY OF THE INVENTION

The present invention relates generally to heat exchanger assemblies, and more particularly to such heat exchanger assemblies employed as evaporator assemblies in ice making machines. The present invention also relates to a method of fabricating such heat exchanger or evaporator assemblies.

Various types of heat exchanger assemblies, including evaporator assemblies for ice making machines, frequently include a wall composed of a heat transmissive material and a plurality of sections of spaced-apart elongated fluid conduits, also composed of a heat transmissive material, disposed on one side of the wall for conveying a heat transfer fluid therethrough in order to transfer heat between the heat transfer fluid in the fluid conduits and the opposite side of the wall. The heat transfer efficiency of such heat exchanger assemblies is largely dependent upon the area of contact for conductive heat transfer between the fluid conduits and the heat transmissive wall. Such heat transfer efficiency is especially important in ice making machines with evaporator assemblies having a generally cylindrical evaporator tube and a helical fluid conduit positioned on the exterior side of the evaporator tube with axially adjacent turns of the helical fluid conduit being axially spaced apart from one another. In such ice making machines, the heat transfer efficiency of the evaporator assembly has a very significant bearing upon the quantity of ice that the ice making machine is capable of producing in a given time, as well as the cost of operating the ice making machine.

In the above-mentioned prior ice making machines, as well as in other heat exchanger devices, the adjacent turns or sections of the fluid conduits are spaced apart from one another and are typically of a cross-sectional shape having generally arcuate sides. Thus the area of contact between the fluid conduit and the heat transmissive wall is typically limited to a relatively small percentage of the outer surface areas of the heat transmissive wall and the fluid conduits, thus resulting in a relatively small heat transmissive conduction or contact area therebetween. Various attempts have been made to increase the area of contact, and thus the area of the heat conductive path, between the heat transmissive wall and the fluid conduits or conduit sections. Several examples of such attempts are disclosed in U.S. Pat. Nos. 1,841,762; 1,886,553; 1,987,707; 2,266,766; 2,578,917; 2,616,270; 3,120,869; 3,143,167; 3,196,624; 3,464,220; 3,972,821; and 4,185,369.

While such previous attempts have met with varying degrees of success, they have either not been fully effective in maximizing the area of contact, and thus the heat conductive path, between the fluid conduit and the heat transmissive wall, or they have done so only by resorting to inordinately complex structures that are difficult and relatively expensive to manufacture and install. Therefore, it is an object of the present invention to improve the area of contact, and thus the heat conductive path, between a fluid conduit or conduit sections and a heat transmissive wall in an evaporator assembly or other heat exchanger device.

A further object of the present invention is to provide such an improved heat exchanger or evaporator assembly that is relatively simple and inexpensive to manufacture and install, and that thus provides an optimized relationship between efficient heat transfer, simplicity, and economy.

In accordance with the present invention, an improved heat exchanger assembly has a wall composed of a heat transmissive material and a plurality of sections of spaced-apart elongated fluid conduits also composed of a heat transmissive material disposed on one side of the wall for conveying a heat transfer fluid therethrough. The assembly includes an elongated filler member extending longitudinally through the space between at least one adjacent pair of the spaced-apart elongated fluid conduits or conduit sections, with the elongated filler member also being composed of a heat transmissive material. The filler member can be disposed relatively close to the adjacent fluid conduits, but spaced slightly therefrom in order to form an elongated space or opening therebetween. A heat transmissive fusion material, such as silver solder for example, substantially fills the elongated space or opening and contacts the filler member, the wall, and fluid conduits in order to bond them to one another and to provide a heat transmissive path therebetween. Preferably, the heat transmissive fusion material is introduced into the assembly in a flowable state, with the flowable fusion material flowing into the elongated space or opening under the influence of capillary action.

In one optional embodiment of the invention, the elongated filler member can include a substantially solid outer surface with a plurality of longitudinally spaced-apart protrusions extending laterally outward from the outer surface. Such optional protrusions contact the adjacent fluid conduits when the filler member is installed in order to provide a plurality of spaces defining a plurality of openings between the filler member and the fluid conduits. In another embodiment of the invention, the filler member is fabricated from a plurality of interconnected heat transmissive wire members, therefore forming an elongated wire mesh structure with the wire members being spaced apart along portions thereof in order to form and define openings in or through the filler member. Preferably, the fluid conduits are composed of a copper-bearing tubing, the filler member is composed of a copper-bearing material, and the fusion material is composed of a silver solder or other such heat transmissive fusing agent.

In the preferred forms of both of the preferred embodiments described above, the filler member is fabricated with a generally three-sided lateral cross-sectional shape, with a first of the three sides of the filler member contacting the heat transmissive wall, and with the other sides being disposed adjacent the fluid conduits. In the optional embodiment described above wherein the filler member has a substantially solid outer surface with laterally outwardly-extending protrusions, such protrusions are disposed on the sides of the three-sided cross-sectional shape that are adjacent the fluid conduit sections. In the various arrangements described above, the above-mentioned opening or openings are defined by the space or spaces between the filler member and the adjacent fluid conduits and/or by the spaces between the above-mentioned heat transmissive wire members. Thus, the flowable fusion material is introduced into the openings and flows by capillary action to substantially fill the spaces or openings between the filler member and the fluid conduit sections, as well as contacting and bonding together the fluid conduit sections, the filler member, and the heat transmissive wall.

In the embodiment mentioned above wherein the filler member is composed of an elongated wire mesh structure, the openings in the wire mesh structure can be disposed throughout the filler member, thereby allowing the flowable fusion material to be introduced into the openings and flow therethrough by capillary action in order to substantially fill the voids in the wire mesh structure and to contact and bond together the fluid conduit sections, the filler member, and the heat transmissive wall. It should further be noted that in any of the embodiments of the present invention, the preferred heat exchanger assembly is substantially coated with the heat transmissive fusion material at least on the side of the heat transmissive wall wherein the fluid conduits and the filler member are disposed.

Additional objects, advantages and features of the present invention will become apparent from the following description and appended claims, taken in conjunction with the accompanying drawings.

BRIEF DESCRIPTION OF THE DRAWINGS

FIG. 2 is an enlarged, detailed cross-sectional view, taken generally along line 2—2 of FIG. 1, of a portion of the wall of the evaporator tube of FIG. 1, illustrating the helical fluid conduit and filler member arrangement according to the present invention disposed on the exterior side of the evaporator tube, with the fusion material shown in phantom lines.

FIG. 2A is a detailed cross-sectional view similar to that of FIG. 2, but illustrating an optional construction wherein the filler member includes optional longitudinally spaced protrusions thereon.

FIG. 3 illustrates a portion of the optional filler member of FIG. 2A, prior to being formed into a generally helical configuration and installed in the evaporator assembly.

FIG. 4 is an enlarged, detailed cross-sectional view similar to FIG. 2, but illustrating another of the embodiments of the present invention.

FIG. 5 is a partial perspective view of a portion of the filler member of the embodiment shown in FIG. 4.

DETAILED DESCRIPTION OF THE PREFERRED EMBODIMENTS

Figure 1:
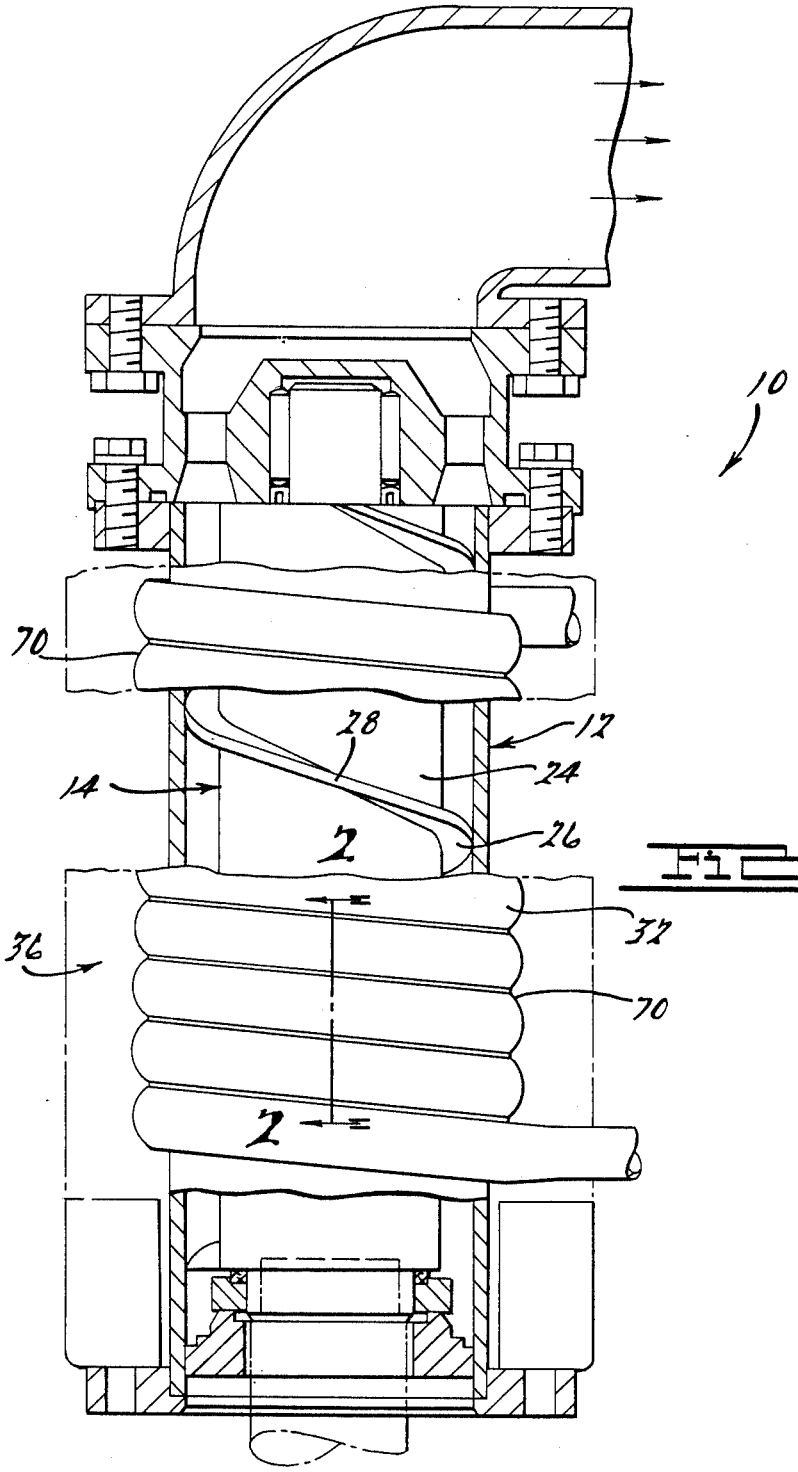
FIG. 1 is an elevational view, partially broken away, of a typical ice making apparatus including an evaporator assembly according to the present invention.

FIGS. 1 through 5 illustrate various embodiments of the present invention as applied to an evaporator assembly for an ice making machine. One skilled in the art will readily recognize, however, that the principles of the present invention apply equally to evaporator assemblies for ice making machines other than that shown for purposes of illustration in the drawings, as well as to other heat exchanger assemblies in general.

FIGS. 1 and 2 illustrate an auger-type ice making machine 10, having an elongated hollow cylindrical or tubular evaporator 12, with an elongated rotatable auger 14 disposed therein. The auger 14 includes an elongated, generally cylindrical-shape central body section 24 that is formed with an integral helical ramp or flight portion 26 defining a helical ice shearing edge 28 disposed closely adjacent the inner peripheral wall of the evaporator tube 12.

A refrigeration coil or fluid conduit 32, which can be composed of a copper-bearing tubing for example, generally surrounds at least a substantial portion of the evaporator 12 and is preferably arranged in a generally helical configuration. A suitable layer of heat insulating material 36 can be disposed around the fluid conduit 12 if deemed necessary or desirable in a given application. As is well known in the art, a supply of ice make-up water is introduced into the interior of the evaporator tube 12 through suitable water supply apparatus (not shown) in order to form a thin layer of ice continuously around the interior surface of the evaporator tube 12. Such ice is formed through the transfer of heat from the ice make-up water through the evaporator tube 12 and the fluid conduit 32 into a heat transfer fluid carried within the fluid conduit 32, in a manner generally well-known in the art. Upon rotation of the auger 14 by a suitable drive motor (not shown), the thin layer of ice is scraped from the interior of the evaporator tube and transferred axially upwardly along the helical flight 26 in order to be compacted or otherwise formed into discrete ice particles in an upper portion of the ice making machine 10.

A preferably helically configured, and circumferentially elongated filler member 50 extends circumferentially around the cylindrical evaporator tube 12 and is interposed in the spaces between axially adjacent turns of the fluid conduit 32. The filler member 50 is preferably a solid member, composed of a heat transmissive material such as a copper-bearing material or the like, having a substantially solid outer surface thereon. Alternately, the filler member 50 can be composed of a heat transmissive generally hollow member, which can be filled with a heat transmissive material, for example.

The filler member 50 is preferably formed with a generally three-sided lateral cross-sectional shape, with a generally flattened (in cross-section) first side 52 preferably engaging the outer surface of the evaporator tube 12 in a generally flush relationship therewith. The other two sides 54 of the filler member 50 are preferably shaped in a generally arcuate configuration in order to closely conform with the outer surfaces of the adjacent fluid conduits 32. One skilled in the art will now readily appreciate that the filler member 50 can also have any of a number of other lateral cross-sectional shapes in lieu of the three-sided shape shown for purposes of illustration in the drawings. The filler member 50 is preferably disposed relatively close to the adjacent fluid conduits 32, but spaced slightly therefrom in order to form and define relatively narrow openings 60 between the filler member 50 and the fluid conduit 32 along at least a substantial portion of their helical lengths when the fluid conduit is installed on the exterior of the evaporator tube 12.

It should be noted that the width of such openings 60 can vary due to inconsistencies in the helical shape of the filler member 50 relative to that of the fluid conduits 32, due to inconsistencies in the placement of the filler member 50 between the fluid conduits 32, or due to other manufacturing or installation tolerances. Furthermore, because of such inconsistencies or tolerances, the filler member 50 can even contact one or more of the turns of the fluid conduit 32, thus causing the opening 60 to close at isolated areas along the length of the filler member 50 or the fluid conduit 32.

A heat fusion material 70, which is preferably a silver solder or other such fusing agent, is disposed within the openings 60, in contact with the fluid conduit 32, the filler member 50, and the evaporator tube 12. Preferably, the heat transmissive fusion material 70 is introduced into the opening 60 in a flowable state and allowed to flow therethrough by capillary action in order to contact and bond together the fluid conduit 32, the filler member 50, and the evaporator tube 12. The fusion material 70 is also preferably applied to all, or at least a substantial portion of, the exterior of the fluid conduit 32, the filler member 50, and the evaporator tube 12 in any suitable manner such as by immersing the evaporator assembly in a bath of molten fusing material, such as molten silver solder for example. By such an arrangement, any inconsistencies in the spacing (or lack of spacing) between the filler member 50 and the fluid conduits 32 are filled with the heat transmissive fusion material 70, and consequently the area of contact, and thus the path of heat conduction, is greatly enhanced in order to improve the heat transfer deficiency of the evaporator assembly. In this regard, it is also preferred that the fluid conduit 32 is provided with radially inner sides 38 that are substantially flattened (in lateral cross-section) in order to conform to, and engage, the outer surface of the evaporator tube 12 in a generally flush relationship therewith, therefore even further enhancing the direct contact and heat transfer relationship between the fluid conduit 32 and the evaporator tube 12.

The evaporator assembly shown in FIGS. 1 and 2 is preferably fabricated by positioning the circumferentially elongated fluid conduit 32 on the outer surface of the evaporator tube 12, with axially-adjacent turns of the fluid conduit 12 in an axially spaced-apart relationship with one another. The heat transmissive filler member 50 is formed into a desired lateral cross-sectional shape, such as the three-sided shape shown in FIGS. 1 and 2. The filler member 50 is interposed in the above-discussed generally helical configuration between the axially spaced-apart turns of the fluid conduit 32 in order to provide and define the above-mentioned openings 60 therebetween.

The fusion material 70 is then introduced into the above-mentioned opening 60, preferably in a molten or flowable state, and is caused to flow into and through the opening 60 under the influence of capillary action. The fusion material 70 contacts and bonds together the fluid conduit 32, the filler member 50, and the evaporator tube 12 in order to provide an enhanced contact area and heat conduction path therebetween. During the course of this operation, the fusion material 70 is preferably applied to all, or at least a substantial portion of, the exterior surfaces of the fluid conduit 32, the filler member 50, and the evaporator tube 12, as mentioned above.

FIGS. 2A and 3 illustrate an optional construction of the filler member 50, wherein an optional filler member 150 includes a number of laterally outwardly-extending protrusions 156 disposed along its circumferentially or helically elongated length, with a number of longitudinal spaces 158 being formed between the protrusions 156 in order to define a number of relatively narrow openings 160 between the filler member 150 and the fluid conduits 132. Such openings 160 function in substantially the same manner as the openings 60 described above and serve to admit a similar heat transmissive fusion material 170 into the assembly. FIG. 3 illustrates the optional filler member 150 prior to being formed into a helical shape or other desired configuration in a given application. Because many of the components of the optional embodiment shown in FIGS. 2A and 3 are identical or similar, either in configuration or function, to corresponding components in FIGS. 1 and 2, such corresponding components are indicated by reference numerals similar to those of FIGS. 1 and 2, but having one-hundred prefixes.

FIGS. 4 and 5 illustrate another of the embodiments of the invention, which is generally similar in many respects to the embodiments discussed above. Therefore, because many of the components of the embodiment of FIGS. 4 and 5 are identical or similar, either in configuration or function, to corresponding components in the embodiment of FIGS. 1 and 2, such corresponding components of the embodiment of FIGS. 4 and 5 are indicated by reference numerals that are similar to those of the corresponding components of the embodiment of FIGS. 1 and 2, but that have two-hundred prefixes.

In FIGS. 4 and 5, the filler member 250 is composed of an elongated wire mesh structure formed from a plurality of heat transmissive, interconnected wire members 262 that are interconnected with one another and spaced apart along portions between such interconnections to provide a plurality of discontinuities forming spaced-apart openings 260 therein. Like the openings 60 and 160 discussed above in connection with the embodiment of FIGS. 1 through 3, the openings 260 provide communication into the spaces between the axially adjacent turns of the fluid conduit 232. Also, similar to that discussed above in connection with the embodiment of FIGS. 1 through 3, a heat transmissive fusion material 270 is introduced into the openings 260 in order to substantially fill the openings 260, to contact and bond together the fluid conduit 232, the filler member 250, and the evaporator tube 212, thereby providing an enhanced area of contact and heat conductive path between these components.

The fabrication of the evaporator assembly in the embodiments of FIGS. 4 and 5 is substantially similar to that of the embodiment of FIGS. 1 through 3, with the exception that the filler member 250 is formed by enmeshing and interconnecting (or otherwise interleaving) the wire members 262 with portions thereof spaced apart in order to form a wire mesh structure with a plurality of discontinuities therein to form the openings 260, which are essentially defined by the spaces between the portions of the wire members 262. Like the filler members 50 and 150 in the embodiment of FIGS. 1 through 3, the wire members 262 are preferably composed of a copper-bearing material, and the fusion material 270 is preferably a silver solder or other such fusing agent that can be introduced into the openings 260 in a substantially flowable state. In addition, the filler member 250 can also be formed with any of a number of lateral cross-sectional shapes in lieu of the exemplary three-sided shape shown in the drawings. In virtually all other respects, the configuration, function, and fabrication of the embodiment of the invention illustrated in FIGS. 4 and 5 is substantially similar to those of the embodiments illustrated in FIGS. 1 through 3.

The foregoing discussion discloses and describes exemplary embodiments of the present invention. One skilled in the art will readily recognize from such discussion and from the accompanying drawings and claims, that various changes, modifications and variations may be made therein without departing from the spirit and scope of the invention as defined in the following claims.

We claim:

1. In an ice making machine having a heat transmissive generally cylindrical evaporator tube, and at least one heat transmissive circumferentially elongated fluid conduit disposed around a substantial portion of the axial length of the cylindrical evaporator tube in a generally helical configuration, axial adjacent turns of the fluid conduit being axially spaced apart, the fluid conduit being adapted for conveying a heat transfer fluid therethrough in order to transfer heat from the interior of the cylindrical evaporator to the heat transfer fluid in the fluid conduit, the improvement comprising: a circumferentially elongated filler member extending circumferentially around the cylindrical evaporator tube in a generally helical configuration and interposed in the spaces between axially adjacent turns of the fluid conduit, said circumferentially elongated filler member being composed of a heat transmissive material and being at least in part spaced apart from at least one of said axially adjacent turns of the fluid conduit in order to define at least one opening providing communication into the spaces between the axially adjacent turns of the fluid conduit; and a heat transmissive fusion material substantially filling said opening and contacting said filler member, the cylindrical evaporator tube and the fluid conduit in order to bond said filler member, the cylindrical evaporator tube and the fluid conduit to one another and to provide a heat transmissive path therebetween, thereby providing for improved heat transfer between the interior of the cylindrical evaporator to the heat transfer fluid.

2. The invention according to claim 1, wherein said circumferentially elongated and helically configured filler member has a generally three-sided lateral cross-sectional shape, a first of said sides of said filler member being generally flat in lateral cross-section and engaging said cylindrical wall in a generally flush relationship therewith, and the other of said sides of said filler member being disposed adjacent the axially-adjacent turns of the fluid conduits.

3. The invention according to claim 1, wherein the fluid conduit is generally flattened in lateral cross-section on a radially inner side of said helical configuration, said flattened side of the fluid conduit engaging the outer side of the cylindrical evaporator in a generally flush relationship therewith.

4. The invention according to claim 1, wherein said heat transmissive fusion material is introduced into said opening in a flowable state, said flowable fusion material flowing into said openings by capillary action.

5. The invention according to claim 4, wherein the cylindrical evaporator, the fluid conduit and said filler member are substantially coated with said heat transmissive fusion material on the exterior side of the cylindrical evaporator.

6. The invention according to claim 5, wherein the fluid conduit is composed of a copper-bearing tubing, said filler member is composed of a copper-bearing material, and said heat transmissive fusion material is composed of silver solder.

7. The invention according to claim 6, wherein said other sides of said filler member are generally concave adjacent their respective adjacent turns of the fluid conduit.

8. The invention according to claim 1, wherein said filler member has a plurality of protrusions extending laterally outwardly therefrom, said protrusions being circumferentially spaced apart along said filler member and contacting the axially adjacent turns of the fluid conduit in order to define a plurality of said openings circumferentially spaced apart from one another and providing said communication into the spaces between the axially adjacent turns of the fluid conduit.

9. The invention according to claim 2, wherein said protrusions are circumferentially spaced apart along said other two sides of said filler member.

10. In an ice making machine having a heat transmissive generally cylindrical evaporator tube, and at least one heat transmissive circumferentially elongated fluid conduit disposed around a substantial portion of the axial length of the cylindrical evaporator tube in a generally helical configuration, axial adjacent turns of the fluid conduit being axially spaced apart, the fluid conduit being adapted for conveying a heat transfer fluid therethrough in order to transfer heat from the interior of the cylindrical evaporator to the heat transfer fluid in the fluid conduit, the improvement comprising: a circumferentially elongated filler member extending circumferentially around the cylindrical evaporator tube in a generally helical configuration and interposed in the spaces between axially adjacent turns of the fluid conduit, said circumferentially elongated filler member being composed of an elongated wire mesh structure formed from a plurality of heat transmissive interconnected wire members spaced apart along portions thereof to define a plurality of spaced-apart openings providing communication into the spaces between the axially adjacent turns of the fluid conduit; and a heat transmissive fusion material substantially filling said openings and contacting said filler member, the cylindrical evaporator tube and the fluid conduit in order to bond said filler member, the cylindrical evaporator tube and the fluid conduit to one another and to provide a heat transmissive path therebetween, thereby providing for improved heat transfer between the interior of the cylindrical evaporator to the heat transfer fluid.

11. The invention according to claim 10, wherein said circumferentially elongated and helically configured filler member has a generally three-sided lateral cross-sectional shape, a first of said sides of said filler member being generally flat and engaging said cylindrical wall in a generally flush relationship therewith, and the other of said sides of said filler member being disposed adjacent the axially-adjacent turns of the fluid conduits.

12. The invention according to claim 10, wherein the fluid conduit is generally flattened on a radially inner side of said helical configuration, said flattened side of the fluid conduit engaging the outer side of the cylindrical evaporator in a generally flush relationship therewith.

13. The invention according to claim 10, wherein said heat transmissive fusion material is introduced into said openings in a flowable state, said flowable fusion material flowing into said openings by capillary action.

14. The invention according to claim 13, wherein the cylindrical evaporator, the fluid conduit and said filler member are substantially coated with said heat transmissive fusion material on the exterior side of the cylindrical evaporator.

15. The invention according to claim 14, wherein the fluid conduit is composed of a copper-bearing tubing, said wire members are composed of a copper-bearing material, and said heat transmissive fusion material is composed of silver solder.

16. The invention according to claim 15, wherein said other sides of said filler member are generally concave adjacent their respective adjacent turns of the fluid conduit.

17. In an ice making machine having a heat transmissive generally cylindrical evaporator tube, and at least one heat transmissive circumferentially elongated fluid conduit disposed around a substantial portion of the axial length of the cylindrical evaporator tube in a generally helical configuration, axial adjacent turns of the fluid conduit being axially spaced apart, the fluid conduit being adapted for conveying a heat transfer fluid therethrough in order to transfer heat from the interior of the cylindrical evaporator to the heat transfer fluid in the fluid conduit, the improvement comprising: a circumferentially elongated filler member extending circumferentially around the cylindrical evaporator tube in a generally helical configuration and interposed in the spaces between axially adjacent turns of the fluid conduit, said circumferentially elongated filler member being composed of a heat transmissive material and having a plurality of discontinuities therealong, said discontinuities and the axially adjacent turns of the fluid conduit defining a plurality of openings providing communication into the spaces between the axially adjacent turns of the fluid conduit; and a heat transmissive fusion material substantially filling said opening and contacting said filler member, the cylindrical evaporator tube and the fluid conduit in order to bond said filler member, the cylindrical evaporator tube and the fluid conduit to one another and to provide a heat transmissive path therebetween, thereby providing for improved heat transfer between the interior of the cylindrical evaporator to the heat transfer fluid.

18. The invention according to claim 17, wherein said circumferentially elongated and helically configured filler member has a generally three-sided lateral cross-sectional shape, a first of said sides of said filler member being generally flat in lateral cross-section and engaging said cylindrical wall in a generally flush relationship therewith, and the other of said sides of said filler member being disposed adjacent the axially-adjacent turns of the fluid conduits, said discontinuities being disposed at least along said other two sides of said filler member.

19. The invention according to claim 17, wherein the fluid conduit is generally flattened on a radially inner side of said helical configuration, said flattened side of the fluid conduit engaging the outer side of the cylindrical evaporator in a generally flush relationship therewith.

20. The invention according to claim 17, wherein said heat transmissive fusion material is introduced into said opening in a flowable state, said flowable fusion material flowing into said openings by capillary action.

21. The invention according to claim 20, wherein the cylindrical evaporator, the fluid conduit and said filler member are substantially coated with said heat transmissive fusion material on the exterior side of the cylindrical evaporator.

22. The invention according to claim 21, wherein the fluid conduit is composed of a copper-bearing tubing, said filler member is composed of a copper-bearing material, and said heat transmissive fusion material is composed of silver solder.

23. The invention according to claim 22, wherein said other sides of said filler member are generally concave adjacent their respective adjacent turns of the fluid conduit.

24. In a method of fabricating an evaporator assembly for an ice making machine having a heat transmissive generally cylindrical evaporator tube, and at least one heat transmissive circumferentially elongated fluid conduit disposed around a substantial portion of the axial length of the cylindrical evaporator tube in a generally helical configuration with axial adjacent turns of the fluid conduit being axially spaced apart, the improvement comprising:

forming a heat transmissive, circumferentially elongated filler in a generally helical configuration;

interpositioning said helical filler member in the spaces between axially adjacent turns of the fluid conduit with at least a portion of said filler member being spaced apart from at least one of said axially adjacent turns of the fluid conduit to form at least one opening providing communication into spaces between the axially adjacent turns of the fluid conduit; and introducing a heat transmissive fusion material into said openings in a flowable state, and causing said flowable fusion material to flow into said openings by capillary action and substantially fill said openings in order to bond said filler member, the cylindrical evaporator tube and the fluid conduit to one another and to provide a heat transmissive path therebetween.

25. The method according to claim 24, including substantially coating the cylindrical evaporator, the fluid conduit and said filler member with said fusion material.

26. The method according to claim 24, including forming a plurality of circumferentially spaced-apart protrusions along said filler member with said protrusions extending laterally outwardly therefrom, and interpositioning said helical filler member in the spaces between axially adjacent turns of the fluid conduit with said protrusions contacting the axially adjacent turns of the fluid conduit to form a plurality of said openings circumferentially spaced apart along said filler member and said fluid conduit.

27. In a method of fabricating an evaporator assembly for an ice making machine having a heat transmissive generally cylindrical evaporator tube, and at least one heat transmissive circumferentially elongated fluid conduit disposed around a substantial portion of the axial length of the cylindrical evaporator tube in a generally helical configuration with axial adjacent turns of the fluid conduit being axially spaced apart, the improvement comprising:

forming a heat transmissive, circumferentially elongated filler in a generally helical configuration from a plurality of wire members, and interconnecting said wire members in a spaced-apart relationship along portions thereof in order to form a wire mesh structure with a plurality of openings being defined by said spaces between said portions of said wire members;

interpositioning said helical filler member in the spaces between axially adjacent turns of the fluid conduit with said openings providing communication into the spaces between the axially adjacent turns of the fluid conduit;

introducing a heat transmissive fusion material into said openings in a flowable state, and causing said flowable fusion material to flow into said openings by capillary action and substantially fill said openings in order to bond said filler member, the cylindrical evaporator tube and the fluid conduit to one another and to provide a heat transmissive path therebetween.

28. The method according to claim 27, including substantially coating the cylindrical evaporator, the fluid conduit and said filler member with said fusion material.

29. A method of fabricating a heat exchanger assembly having a wall composed of a heat transmissive material, and a plurality of elongated fluid conduit sections also composed of a heat transmissive material for conveying a heat transfer fluid therethrough on one side of the wall, said heat exchanger assembly being adapted for transferring heat between the heat transfer fluid in the fluid conduits and the opposite side of the wall, said method comprising:

positioning at least a pair of the elongated fluid conduit sections in a spaced-apart relationship adjacent one side of the wall;

providing a heat transmissive elongated filler member, and forming a plurality of discontinuities on said elongated filler member;

positioning said elongated filler member generally adjacent the wall and extending longitudinally in the space between the adjacent elongated fluid conduit sections with said discontinuities defining at least one opening providing communication into the space between the adjacent fluid conduits; and introducing a heat transmissive fusion material into said openings in contact with said filler member the wall and the fluid conduits in order to substantially fill said openings in order to bond said filler member, the wall and the fluid conduits to one another and to provide a heat transmissive path therebetween.

30. The method according to claim 29, including forming said filler member from a plurality of wire members, interconnecting said wire members in a spaced-apart relationship along portions thereof in order to form a wire mesh structure with a plurality of said openings being defined by said spaces between said portions of said wire members.

31. The method according to claim 30, including introducing said heat transmissive fusion material into said openings in a flowable state in order to allow said flowable fusion material to flow into said openings by capillary action.

32. The method according to claim 31, including forming the fluid conduits from a copper-bearing tubing, forming said wire members from a copper-bearing material, providing a fusion material composed of silver solder, and melting said silver solder into said flowable state prior to introducing said silver solder into said openings in order to cause said flowable silver solder to flow into said openings by capillary action.

33. The method according to claim 29, including substantially coating said heat exchanger assembly with said heat transmissive fusion material on the side of the wall wherein the fluid conduits and said filler member are disposed.

34. The method according to claim 29, wherein the wall is generally cylindrical in shape, said method including forming the fluid conduit sections in at least one generally helical configuration with spaced-apart turns thereof, positioning the fluid conduit sections around the exterior of the cylindrical wall, forming said filler member in at least one generally helical configuration with spaced-apart turns thereof, and positioning said spaced-apart turns of said filler member in the spaces between the spaced-apart turns of the fluid conduit.

35. The method according to claim 29, further including forming said elongated filler member with a substantially solid outer surface, said step of forming said discontinuities including forming a plurality of longitudinally spaced-apart protrusions therealong extending laterally outward from said outer surface, said step of positioning said filler member including positioning said filler members in the space between the adjacent fluid conduits so that said protrusions are in contact with the fluid conduits in order to provide a plurality of spaces between said filler member and the fluid conduits in order to define a plurality of said openings between the fluid conduits and said outer surface of said filler member.

36. The method according to claim 35, further including forming said elongated filler member with a generally three-sided lateral cross-sectional shape, forming said longitudinally spaced-apart protrusions on two of said sides, positioning a third of said sides of said filler member in contact with the wall and said two of said sides of said filler member adjacent the spaced-apart fluid conduits.

37. The method according to claim 36, including flattening one side of the fluid conduits, and positioning said flattened side of the fluid conduits in a generally flush engagement with the wall.

38. The method according to claim 29, including introducing said heat transmissive fusion material into said opening in a flowable state in order to allow said flowable fusion material to flow into said openings by capillary action.

39. The method according to claim 38, including forming the fluid conduits from a copper-bearing tubing, forming said filler member from a copper-bearing material, and providing a fusion material composed of silver solder.

* * * * *